US005270680A

United States Patent [19]

Lahaye et al.

[11] Patent Number: 5,270,680

[45] Date of Patent: Dec. 14, 1993

[54] LOUD HORN WITH RESPIRATION PIPE AND IN PARTICULAR FOR MOTOR VEHICLES

[75] Inventors: Patrick Lahaye, Paris; Claude DeCorde, Autheuil-Authouillet, both of France

[73] Assignee: Klaxon S.A., France

[21] Appl. No.: 666,281

[22] Filed: Mar. 8, 1991

[30] Foreign Application Priority Data

Mar. 8, 1990 [FR] France ..... 90 02927

[51] Int. Cl.[5] ..... G08B 3/00; G10K 9/00

[52] U.S. Cl. ..... 340/388; 340/387; 340/404; 116/137 R; 116/142 R

[58] Field of Search ..... 340/383, 387, 391, 392, 340/404; 116/142 R, 137 R

[56] References Cited

U.S. PATENT DOCUMENTS 4,441,099 4/1984 Neese ..... 340/388
4,763,109 8/1988 Smith ..... 340/388

FOREIGN PATENT DOCUMENTS 2279187 2/1976 France ..... 340/388

*Primary Examiner*—Donnie L. Crosland
*Attorney, Agent, or Firm*—William A. Drucker

[57] ABSTRACT

A loud horn for motor vehicles which comprises a hollow housing sealed off by a diaphragm and bearing a vibration electromagnetic generator inside the housing with a coil frame in which the housing is provided with a hole connecting the inside of the housing with the outside allowing for respiration of the loud horn. In order to communicate with said hole, the frame has at least one smaller diameter pipe in order to allow air to penetrate inside the housing, the pipe being provided with a filter preventing water from penetrating inside the loud horn.

10 Claims, 3 Drawing Sheets

LOUD HORN WITH RESPIRATION PIPE AND IN PARTICULAR FOR MOTOR VEHICLES

FIELD OF THE INVENTION

The present invention concerns loud horns, in particular for motor vehicles of the type comprising a hollow housing sealed off by a diaphragm and bearing an electromagnetic vibration generator provided, inside the housing, with a coil frame bearing a coil.

BACKGROUND OF THE INVENTION

This type of horn is described in the document FRA-2 069 792.

By virtue of its design, the loud horn heats up when it operates.

In effect, a temperature increase, provoked by the electromagnetic generator, inside the volume of the housing closed by the diaphragm results in an increase of the internal pressure.

This is why in the above-mentioned document a respiration hole has been provided so as to facilitate exchanges with the outside and enabling the external and internal pressures to be balanced.

This hole may be calibrated and itself form means for protection against water penetration.

In one variant, it is possible to add to the hole a filter protecting the horn from water penetrating.

This hole is embodied for one portion formed by injecting plastic material into the housing, protection being provided by a sheath or tube.

In one variant, the skirt of the housing extends outwardly by a tube overlapped by a protection cap.

All these dispositions complicate the production of the housing and in certain cases are not optimal as the holes may become clogged.

In addition, this results in embodying projections which may encumber implantation of the loud horn.

Moreover, prior to mounting, this increases risks of damage occuring to the horn by incorrect handlings.

So as to protect the respiration hole of the horn, the document FR-A-2 279 187 concerns providing an external cap which communicates with the outer atmosphere via a labyrinth hole.

The document FR-A-1 335 125 concerns an orifice to be inserted which opens into the air at a location protected from external sprayings by means of a wall forming a screen.

SUMMARY OF THE INVENTION

The object of the present invention is to overcome the drawbacks of known devices by simply and economically creating a simple robust production respiration system with completely reliable functioning and reducing to a minimum any incorrect manipulations, whilst also procuring other advantages.

According to the invention, a horn of the above-mentioned type is characterized in that, in order to communicate with the hole of the housing, the frame has at least one pipe with a small section so as to allow air to pass, said pipe being provided with means so as to prevent water from penetrating inside the horn.

By means of the invention and without adversely affecting the performance of the horn, existing parts are made full use of and the production of the housing is simplified, the hole it contains not needing to be precise.

In addition, the embodiment of the pipe is rendered easier, especially when the frame is made of plastic.

Furthermore, there is no risk or damaging or losing any cap prior to mounting the horn or of damaging the horn respiration system when making incorrect manipulations.

The housing and the frame may be produced in different production units.

Advantageously, the pipe is formed from the fixing ears of the frame.

In all cases, tests have showed that it was not necessary to protect the hole of the housing, the pressure increase inside the horn sufficing to move any possible waste substances to the pipe inlet.

In addition, it is easy to implant a filter at the pipe inlet, the pipe outlet or at any location.

BRIEF DESCRIPTION OF THE DRAWINGS

The following description illustrates the invention with reference to the accompanying drawings on which.

DETAILED DESCRIPTION OF THE PREFERRED EMBODIMENTS

Figure 1:
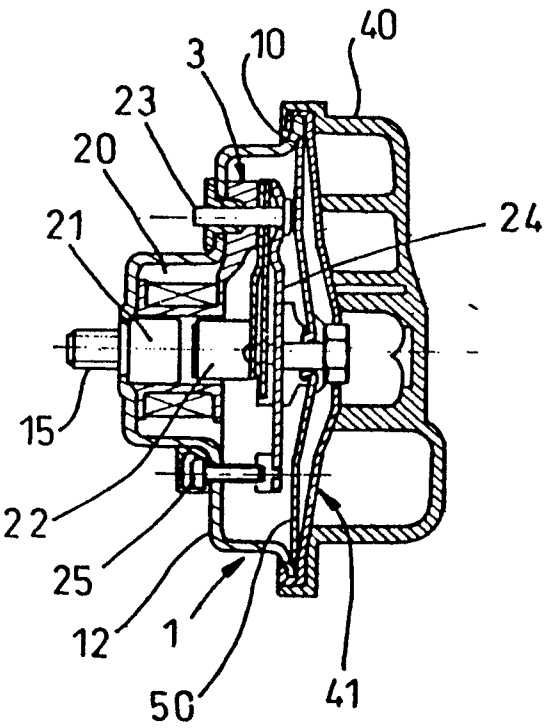
FIG. 1 is an axial cutaway view of a low frequency type loud horn according to the invention.
Figure 2:
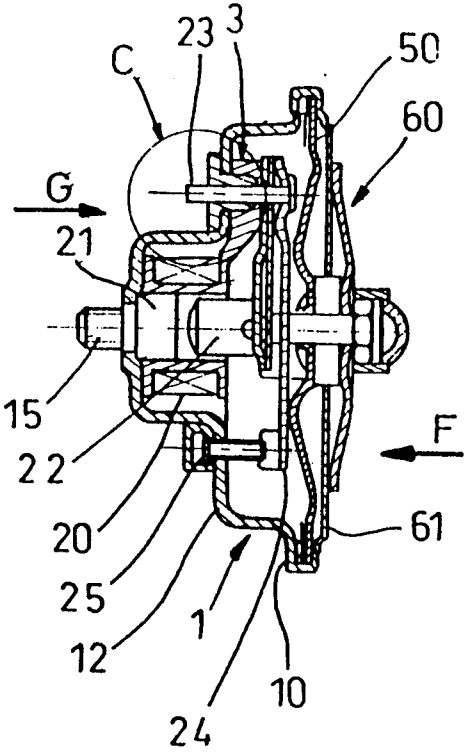
FIG. 2 is an axial cutaway view similar to FIG. 1 but for a high frequency type loud horn.

In FIGS. 1 and 2, the motor vehicle loud horn, also known as an electroacoustic signalling siren, comprises a hollow housing 1 fixed to a fixed support delimiting a cavity blocked off by a membrane 50.

Inside its cavity, the housing 1 bears an electromagnetic vibration generator with an excitation coil 20 borne by a coil frame 3 and wound onto the latter.

The frame 3 is centrally hollow by being mounted onto a fixed core 21. A solenoid plunger 22 is allowed to penetrate inside the frame so as to draw close to the fixed core 21.

The solenoid plunger 22 is integral with the membrane 50 and with the latter forms a mobile mounting.

The figures show at 23 one of the feed terminals of the coil 20 and at 24 a conductive contact holder plate with at 25 an air gap adjustment screw.

The electromagnetic vibration generator forms an excitation device which transmits a movement to the membrane so that the volume of the cavity delimited by the housing 1 varies.

On FIG. 1, the mobile membrane 50/solenoid plunger mounting 22 is inserted between a metallic receiving plate 41 and a flange 10 of the housing with a gasket being added.

The plate 41 forms a cover for a hollow plastic roof 40 provided with a cavity communicating with a central recess of the plate and an orifice projecting into the open air.

The roof 40 is provided with a shouldered opening, whereas the plate 41 renders the housing 1 and the membrane 50 integral by virtue of its edge folded onto the membrane 50 and the housing 1.

The plate is glued onto the roof, as described in the document FR-A-2 335 903 and comes into contact with the shouldered opening of the roof.

On FIG. 2, the flange 10 is linked to the membrane 50 by a ring 61 crimped onto the flange 10.

The membrane 50 is integral with a disk 60 disposed beyond the ring 61 so as to form a resonator.

In the case of the siren of FIG. 1, the movement of the membrane causes the volume delimited by the membrane 50 and the plate 41 to vary so as to produce a sound.

In the case of a high frequency type horn shown on FIG. 2, the solenoid plunger 22 integral with the membrane 50 strikes the fixed core 21 so as to propagate a sound wave amplified by the disk 60.

In these figures, the housing 1 is ring-shaped and made of swaged sheet metal and comprises further to the flange 10 forming a radial shoulder directed opposite the axis of the assembly, one first tubular portion delimited by an axial skirt 11 being connected to the flange 10, one annular transversal wall 12 being connected to the skirt 11 and bearing a second ring-shaped portion with a smaller diameter and delimited by an axial skirt 13 and closed by a transversal bottom 14.

The coil 20 is housed with its frame 3 inside the skirt 13, the frame 3 taking support on the bottom 14 centrally opened to allow for the passage of a threaded part 15 integral with the fixed core 21 with a larger diameter.

The core 21 rests on the bottom 14 inside the housing 1 and is used as an annular centerer for the frame 3, whereas the portion 15 is used to fix the housing 1 to an elastic tongue (not visible) integral with one fixed section of the vehicle.

The frame 3 has firstly one main section 31 rendered centrally hollow so as to cooperate on centering with the core 21, and secondly a U-shaped section to allow for mounting of the coil 20.

The hollow housing 1 has a hole 6 so as to connect the inside of the housing 1 with the outside and ensure that the movement of the membrane 50 is not altered by any excess pressure or partial vacuum existing in the housing.

According to the invention, in order to communicate the hole 6 of the housing 1, the frame 3 has at least one cylindrical pipe 2 of smaller diameter so as to allow for the passage of air as far as inside the housing 1, said pipe 2 being provided with means to prevent water from penetrating inside the horn.

More specifically, it is the wall 12 of the housing 1 which is pierced so as to form the hole at a zone freed from the zone bearing the feed terminals 23 close to the latter and one of the coil fixing points, as described hereafter.

In order to do this, the frame 3, preferably a plastic frame, has two fixing ears 32 and 33 integral with a radial extension 35 extending in excess thickness inside the housing 1 in contact with the wall 12 and being connected to the extremity of the main section 31 opposite the bottom 14 by a connecting fillet 37.

Figure 3:
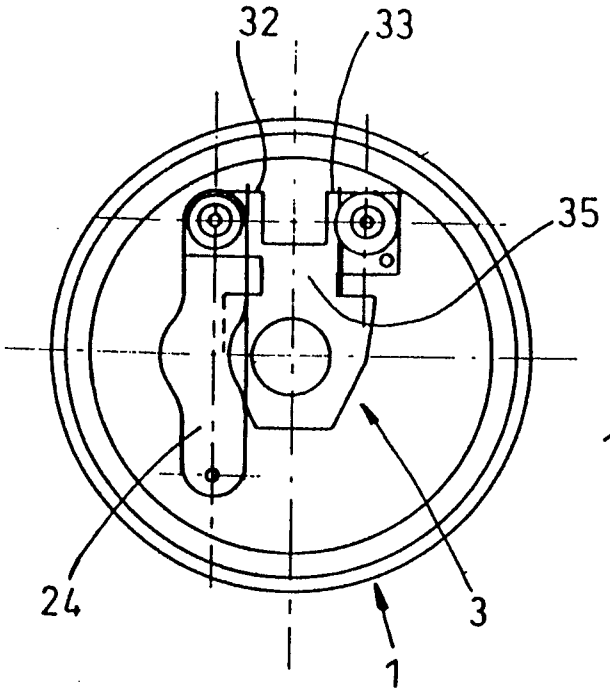
FIG. 3 is a view along the arrow F of FIG. 2 of the housing equipped solely with its frame and its contact holder plate.
Figure 5:
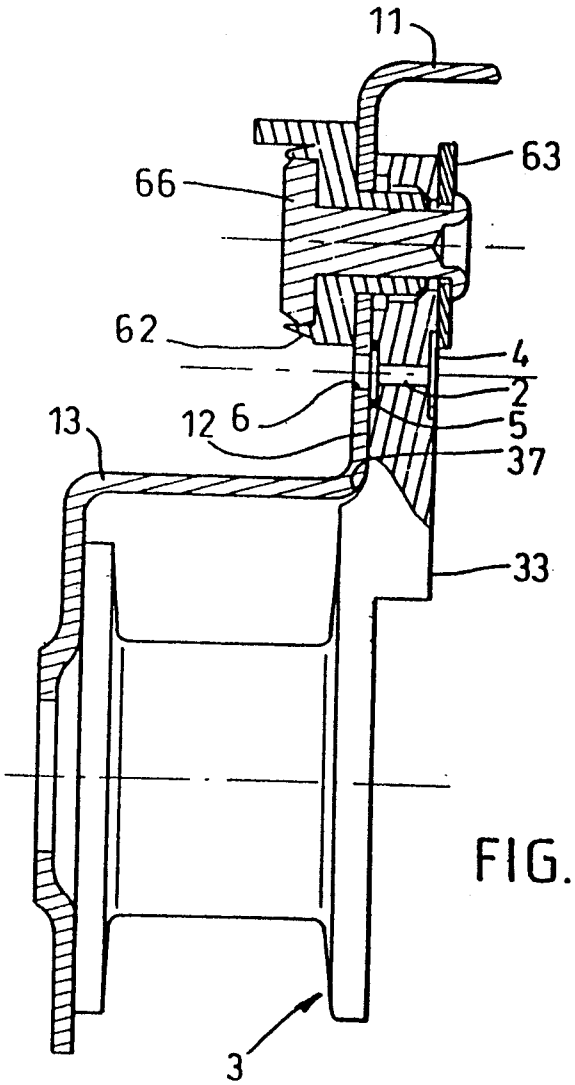
FIG. 5 is a cutaway view along the line 5-5/6 of FIG. 4.
Figure 4:
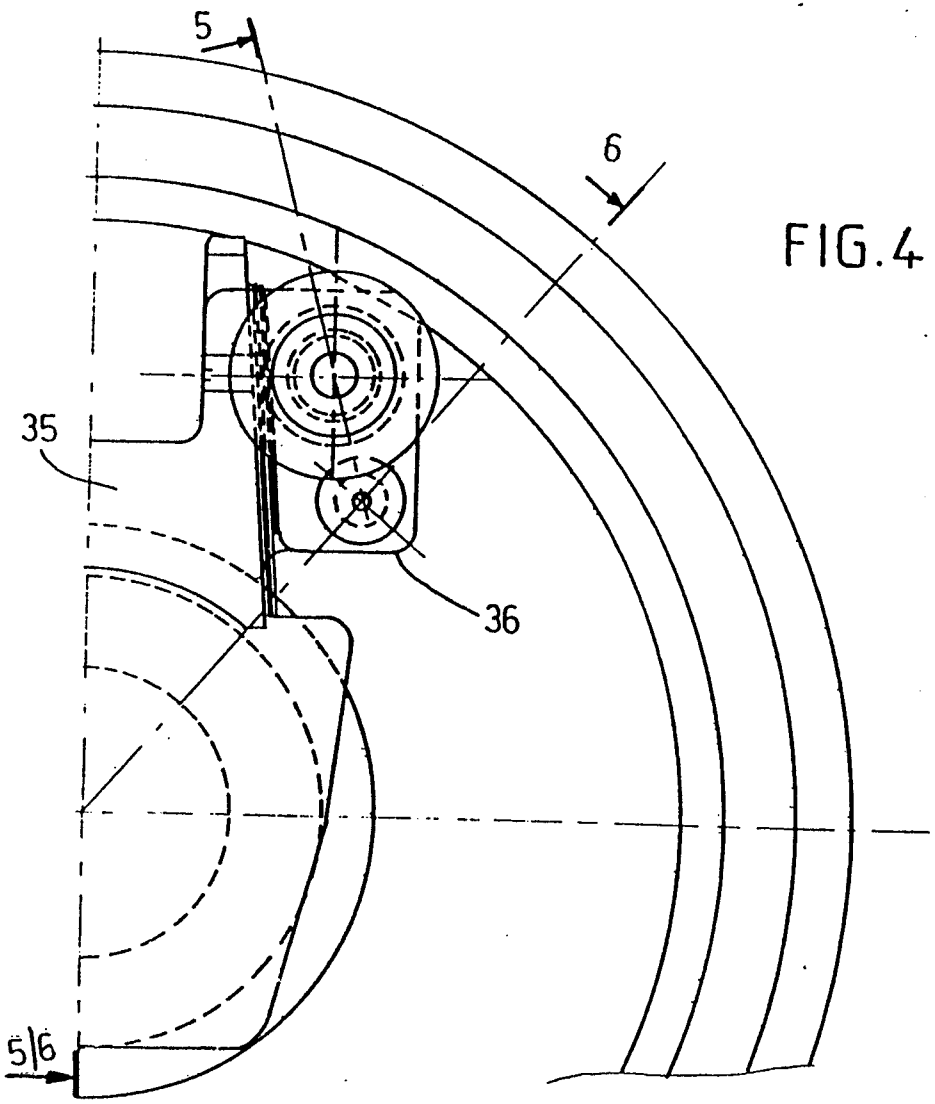
FIG. 4 is a view along the arrow G of FIG. 2 and showing on larger scale the details marked by the insert C of FIG. 2.
Figure 6:
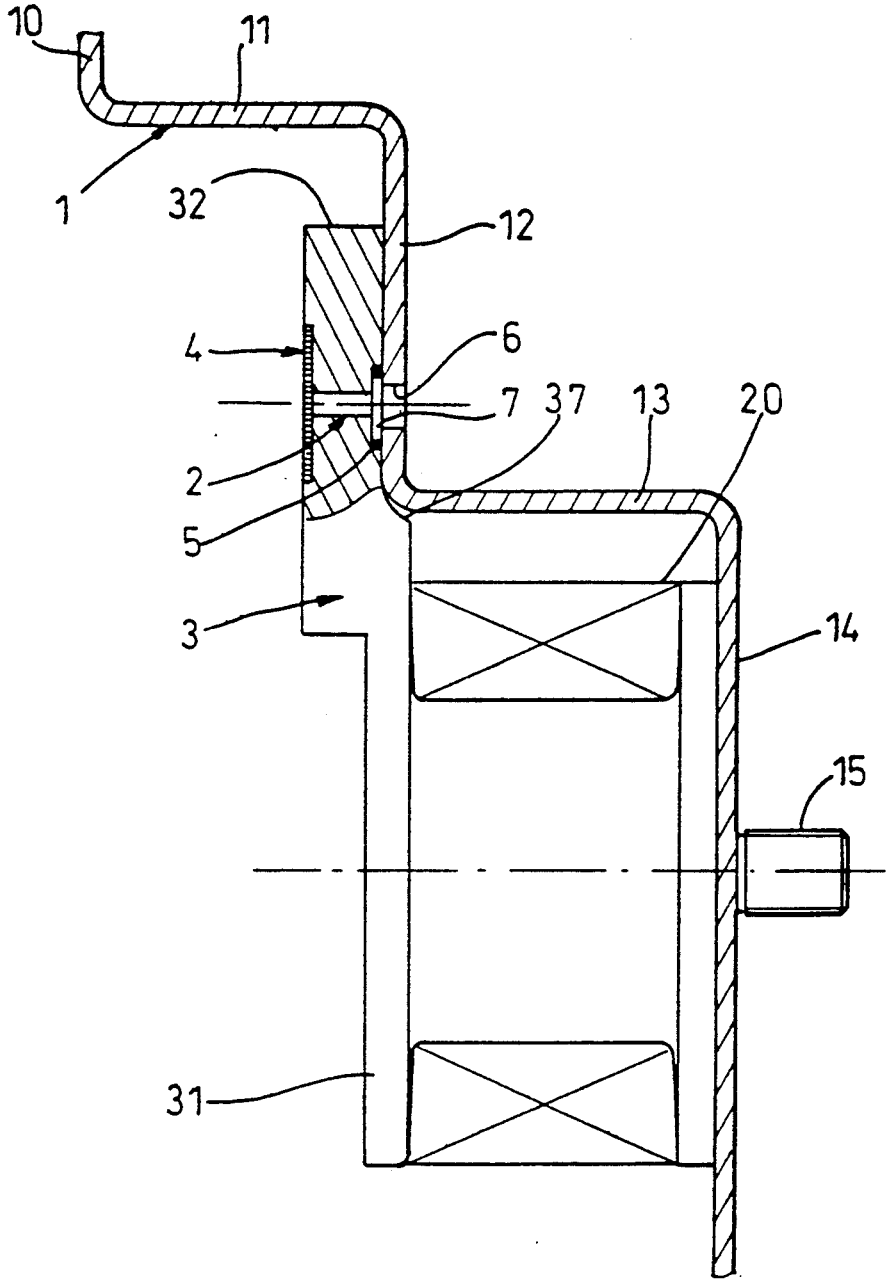
FIG. 6 is a cutaway view along the line 6-5/6 of FIG. 4.

The extension 35 with its ears 32, 33 forms a fork with two radial arms bearing the ears which are not identical. Both these ears are used to fix the frame 3 to the housing 1, but the ear 32 is also used to fix the plate 24 which extends radially over a large height on both sides of the axis of symmetry and radially beyond the frame 3 (FIG. 3), whereas the ear 33 has a protuberance 36 or excrescence.

The pipe 2 is used for this protuberance 36 and is opposite the hole 6, the center of the hole being disposed on the axis of the pipe 2.

This pipe 2 is connected to a recess 7 made in the face of the protuberance 36 adjacent to the wall 12, whereas the other face of the protuberance is recessed so as to house a filter 4 provided with pores and preventing water and moisture penetrating inside the housing 1.

Here, the pipe 2 extends parallel to the axis of the assembly and thus opens into the recess 7 and the filter 4 kept in place by a high frequency weld, glueing or by clamping.

The recess 7 has a diameter larger than that of the hole 6 and is used to trap impurities.

An O-ring 5 is mounted in the recess 7 by being placed between the frame 3 and the wall 12 so as to ensure imperviousness between these two components and prevent corrosion phenomena.

Of course, the filter 4 may be placed at any location in the pipe 2, for example at the inlet of the latter in the cavity 7.

As a variant, it is possible to insert it inside the thickness of the protuberance 36 in the middle of the pipe.

In all cases, in the event of any excess pressure or partial vacuum occurring inside the housing, respiration is possible via the hole 6 and the pipe 2 without altering the sound of the horn.

Tests have shown that increasing the pressure in the horn suffices to move any possible waste substances to the inlet 7 of the pipe 2.

It can be readily understood that the frame 3 is subjected to vibrations due to the fact that it is penetrated by the core 22 and bears the vibrating plate 24, thus also favoring opening of the pipe 2.

It shall be observed that the disposition is robust as it does not project externally with respect to the simplified housing.

It shall be observed that the disposition close to the ear 33 is favorable.

In fact, a good contact takes place between the frame 3 and the wall 12 due to the presence of the fixing member 66, in this instance a rivet or, as a variant, a bolt traversing the ear 33 for a mounted part 62 driven into a hole of the ear 32 and having a shouldered section in contact with the external face of the wall 12.

This part 62 blocks the head of the rivet by means of a lip favoring full imperviousness.

The extermity of the rivet 66 is crimped to the contact of a metallic distribution washer 63 taking support on the face of the ear 33 farthest from the wall 12.

The feed terminals 23 are welded onto the rivets 66.

Thus, it can be readily understood from the description that the hole 6 does not need to be accurately calibrated and the pipe 2 may be accurately embodied independently of the housing in a different production unit.

Of course, the present invention is not merely restricted to the embodiment example described and in particular the pipe 2 may be placed at any location of the frame, especially in the actual radial extension 35, the hole accordingly being displaced.

Similarly, the frame may have an additional specific ear for the pipe and the radial extension 35 may be provided without fixing ears.

In all cases, the embodiment by moulding of the plastic frame lends itself to assuming a large number of shapes.

The presence of the filter 4 preventing water from penetrating is not obligatory, the pipe 2, whose length depends on various applications, being able to be calibrated so as to allow air to pass but not water and thus itself form means to prevent water from penetrating inside the horn. Similarly, the recess 7 may be dispensed with.

This pipe may open into a coaxial pipe with a larger diameter to allow for mounting of the filter 4 which is then closer to the wall 12.

The hole 6 may be radially offset with respect to the pipe 2 and be connected to the latter for a recess similar to the recess 7, which is accordingly extended.

The pipe 2 may be slanted with respect to the axis of the assembly.

The frame may have a tube penetrating into the hole of the housing.

The frame may have an axial edge opposite the skirt 11 in which the pipe 2 is provided.

Finally, the pipe 2, instead of having a cylindrical bore, may have a section of any shape being smaller than the hole 6.

What is claimed is:

1. Loud horn, and in particular for motor vehicles, of the type comprising a hollow housing blocked off by a membrane and bearing an electromagnetic vibration generator provided inside the housing with a solenoid plunger and a coil frame integral with the housing and bearing an excitation coil, said frame being hollow to enable the solenoid plunger to penetrate, in which the housing is provided with a hole connecting the inside of the housing with the outside to allow for respiration of the loud horn, wherein said frame has, in order to communicate with said hole, at least one pipe with a smaller section so as to allow air to pass into the housing, said pipe being provided with means preventing water from penetrating inside the housing of the loud horn.

2. Horn according to claim 1, wherein the pipe is opposite the hole of the housing.

3. Horn according to claim 1, wherein the pipe is radially offset with respect to the hole of the housing.

4. Horn according to claim 1, wherein the inlet of the pipe opens into a recess with a larger section.

5. Horn according to claim 4, wherein a joint is mounted in said recess by being placed between said frame and one wall of the housing so as to ensure imperviousness between these two components.

6. Horn according to claim 1, wherein the pipe communicates with a filter provided with pores so as to prevent water and moisture from penetrating into the housing.

7. Horn according to claim 1 wherein the pipe is calibrated so as to form means preventing water from penetrating into the loud horn.

8. Horn according to claim 1, wherein the frame of the coil is a plastic frame having one ear in which said pipe is formed.

9. Horn according to claim 8, wherein said ear is a fixation means of the coil frame to the housing, said pipe being formed in a protuberance of this ear.

10. Horn according to claim 1, wherein the coil frame is made of plastic and has, in excess thickness inside the housing, a radial extension, and wherein said pipe is formed in said radial extension.

* * * * *